US007730929B2

(12) United States Patent
Perron

(10) Patent No.: US 7,730,929 B2
(45) Date of Patent: Jun. 8, 2010

(54) MULTI-LEVEL EXTERNAL WINDOW SHUTTER

(76) Inventor: Jocelyn Perron, 895, Avenue Joffre, Québec (CA) G1S 3L9

( * ) Notice: Subject to any disclaimer, the term of this patent is extended or adjusted under 35 U.S.C. 154(b) by 188 days.

(21) Appl. No.: 11/446,230

(22) Filed: Jun. 5, 2006

(65) Prior Publication Data

US 2006/0272215 A1 Dec. 7, 2006

Related U.S. Application Data

(60) Provisional application No. 60/686,951, filed on Jun. 3, 2005.

(51) Int. Cl.

| | |
|---|---|
| ***E05D 15/00*** | (2006.01) |
| ***E05C 7/06*** | (2006.01) |
| ***E05F 17/00*** | (2006.01) |
| ***E06B 3/48*** | (2006.01) |
| ***E06B 9/08*** | (2006.01) |

(52) U.S. Cl. ..... 160/202; 160/118; 160/122; 49/123

(58) Field of Classification Search ..... 160/222, 160/220, 202, 197, 196.1, 118, 117; 49/125, 49/362, 366, 370, 61, 62, 63; 52/243.1
See application file for complete search history.

(56) References Cited

U.S. PATENT DOCUMENTS

| | | | | |
|---|---|---|---|---|
| 2,611,936 | A | 9/1952 | Wheeler | |
| 3,072,394 | A * | 1/1963 | Urquhart | 49/102 |
| 3,494,073 | A | 1/1968 | Meddick | |
| 3,452,477 | A * | 7/1969 | Sassano | 49/116 |
| 4,242,836 | A | 1/1981 | Anderson | |
| 4,457,106 | A * | 7/1984 | Forquer | 49/158 |
| RE34,360 | E * | 8/1993 | Carlson et al. | 160/199 |
| 5,893,242 | A | 4/1999 | Perron | |
| 6,234,237 | B1 * | 5/2001 | Skands | 160/196.1 |
| 6,658,793 | B2 | 12/2003 | Perron | |
| 7,174,944 | B1 * | 2/2007 | Clark et al. | 160/197 |
| 2002/0017060 | A1 * | 2/2002 | Kern et al. | 49/231 |

* cited by examiner

*Primary Examiner*—Katherine W Mitchell
*Assistant Examiner*—Jeremy C Ramsey
(74) *Attorney, Agent, or Firm*—Equinox Protection; Franz Bonsang

(57) ABSTRACT

A multi-level window shutter has a shutter frame movably supporting at least one first level external shutter panel via an external panel opening mechanism mounted on the shutter frame. The external panel movably supports at least one second level internal shutter panel via an internal panel opening mechanism mounted on the external panel and connected to the shutter frame and to the internal panel for simultaneous displacement of the internal panel upon displacement of the external panel relative to the shutter frame. The panels move between a closed position in which they are in a side-by-side configuration relative to one another in spaced apart parallel planes and an open position in which they are in an over-one-another configuration relative to each other in the spaced apart parallel planes.

19 Claims, 8 Drawing Sheets

MULTI-LEVEL EXTERNAL WINDOW SHUTTER

CROSS REFERENCE TO RELATED APPLICATIONS

Benefit of U.S. Provisional Application for Patent Ser. No. 60/686,951, filed on Jun. 3, 2005, is hereby claimed.

FIELD OF THE INVENTION

The present invention relates in general to external window shutters, and more particularly to a shutter system having a driving mechanism which permits the simultaneous opening and closing displacement of at least two shutter panels of an external window shutter located on different levels.

BACKGROUND OF THE INVENTION

External window shutter units to cover and uncover window openings by the simultaneous displacement of individual shutter panels have been known for some time. Their manipulation and utilization was largely dependent on some form of carriage track assembly in conjunction with a cable and pulley driving mechanism.

Earlier embodiments of external shutter systems require that each shutter panel have its own cable and pulley mechanism thus requiring two bore holes in the wall to accommodate the drive shafts for each shutter panel. Also disclosed are systems with off-frame guides on which the shutters rest when in the open configuration. In both open and closed configurations, the off-frame guides and channels are exposed to the elements and particulate matter that may hamper the operation of the shutters, depending on the weather conditions such as icing rain, snow, etc.

In a situation where the fenestration configuration involves more than two window panels, the installation of conventional external shutter systems becomes impractical since the window opening would never be able to be entirely uncovered due to the inherent overlap of the shutter panels when in the open configuration.

Additionally, earlier shutter systems, so called "storm shutters" were entirely designed to protect the glass windowpanes from breakage or loosening in tempestuous situations. Contemporary building components and methods known in the art now allow for the construction of shutter systems that are both thermally insulating and weather-sealed to provide all round protection from the elements while at the same time serving to perform the original function.

More specifically, the opening mechanism used to actuate any additional level (or layer) of shutter panels are generally complex when panels are designed to ensure proper sealing and insulation and are independent from the first level mechanism such that the panels of different levels are alternately actuated. Also, such mechanisms are typically exposed to weather conditions.

Accordingly, there is a need for an improved multi-level window shutter.

SUMMARY OF THE INVENTION

It is therefore a general object of the present invention to provide an improved multi-level external window shutter.

Advantages of the present invention are that the multi-level external window shutter obviates the above-mentioned disadvantages; the window shutter being composed largely of aluminum and having as its innovative aspect, a driving mechanism allowing for the simultaneous displacement of different levels of shutter panels.

An advantage of the present invention is that the multi-level window shutter secures the shutter panels hermetically against each other to effectively protect the window opening from the weather induced elements when in the closed configuration.

Another advantage of the present invention is that multi-level window shutter includes panels that contain within them rigid insulation material known in the art thereby providing additional R-value thermal protection when the shutter system is in the closed configuration.

Still another advantage of the present invention is that the multi-level window shutter is provided with a novel driving mechanism easily activated from inside the building to simultaneously displace all levels of shutter panels, in either one or two opposing directions whenever applicable.

Another advantage of the present invention is that the multi-level window shutter is pre-assembled on a frame that mounts on an external wall surrounding the window opening by virtue of fastening methods well known in the art.

Still a further advantage of the present invention is that the multi-level window shutter can be custom made to accommodate any window-opening dimension, and space available on the periphery thereof.

Yet another advantage of the present invention is that the multi-level window shutter is especially suitable for cover large windows and requires relatively small spaces adjacent thereof when in the fully open configuration, with the panels from each level being superimposed or juxtaposed relative to one another, and in a cantilever fashion from the frame of the multi-level window shutter.

Still another advantage of the present invention is that the multi-level window shutter can be opened on a single side of the window when an obstruction or no backing structure (such as wall surface) exits on the other side.

According to an aspect of the present invention, there is provided a multi-level window shutter having a shutter frame movably supporting at least one generally planar first level external shutter panel between an external closed position and an external open position and an external panel opening mechanism mounted on the shutter frame and connected to the external panel for selective displacement thereof relative to the shutter frame, the window shutter comprises: at least one generally planar second level internal shutter panel movably, directly and entirely supported by the external shutter panel, between an internal closed position with the external and internal panels being substantially in a generally side-by-side configuration relative to one another in spaced apart parallel planes with the external panel being in the external closed position and an internal open position with the external and internal panels being in a generally over-one-another configuration relative to one another in the spaced apart parallel planes with the external panel being in the external open position; and an internal panel opening mechanism mounted on the shutter frame and connected to the external panel and to the internal panel for simultaneous displacement of the internal panel upon displacement of the external panel relative to the shutter frame, the internal panel opening mechanism being physically independent from the external opening mechanism and being activated by the external panel upon displacement thereof relative to the shutter frame.

In one embodiment, the external panel includes an external panel frame having a frame extension for supporting the internal panel when in the internal closed position, the frame extension extending generally internally away from the external panel frame in the plane of the external panel.

Conveniently, the frame extension extends at least from an upper section of the external panel frame for selectively supporting an upper section of the internal panel, and over a length substantially equal to a width of the internal panel so as to support the internal panel over its entire width when in the internal closed position.

Typically, the internal opening mechanism includes an elongated flexible link having first and second ends attachably connectable to the shutter frame, the flexible link movably mounting on the external panel frame and attaching to the internal panel for displacement thereof upon displacement of the external panel.

Conveniently, the internal opening mechanism includes a pair of link engagement gears pivotally mounted on the external panel frame, the flexible link engaging the gears and defining a link internal section therebetween, the internal panel attachably connecting to the link internal section of the flexible link. Typically, the flexible link further defines first and second link end sections extending in substantially opposite directions from the link internal section between corresponding first and second link end and a respective said gears, the first and second link end sections substantially intersecting one another.

Conveniently, the flexible link is a cable wire and the first and second gears are first and second cable pulleys.

Conveniently, at least one of the first and second link ends is rigidly attached to the shutter frame. Typically, the link is also elastically attached to the shutter frame via a cable tensioning mechanism, preferably a tension spring, connected to the link and the shutter frame adjacent a link end thereof, also attached to the shutter frame. The cable tensioning mechanism ensures a tension in the flexible link.

In one embodiment, the internal opening mechanism allows for a linear displacement of the internal panel to be substantially twice a simultaneous linear displacement of the external panel.

In one embodiment, the internal panel includes a guide channel engaging a plurality of support rollers pivotally mounted on the external shutter panel.

Conveniently, the guide channel and the plurality of support rollers are located within a guiding plane substantially parallel to the panel planes, and typically with the guiding plane being substantially coplanar with the external panel plane.

In one embodiment, the internal opening mechanism is located on both upper and lower sections of the shutter frame and the external and internal shutter panels. Typically, the internal opening mechanism located on the lower sections of the shutter frame and the external and internal shutter panels is oriented in a plane generally perpendicular to the external and internal panel planes.

In one embodiment, the window shutter further includes an out-of-plane retaining mechanism mounted on the external panel and connected to the shutter frame to prevent any out-of-plane displacement of the external panel relative to the shutter frame. Conveniently, the retaining mechanism includes a flexible wire secured to the external shutter panel slidably engaging a corresponding pin attached to the shutter frame between the external open and closed of the external shutter panel.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

Given that many of the elements in the preferred embodiment of the present invention are well known in the art and have been adequately described in previous disclosures, such as in the present inventor's U.S. Pat. Nos. 5,893,242 and 6,658,793, the following descriptions and drawings will, for the sake of brevity, concern themselves largely with the innovative aspect of the preferred embodiment of the present invention, that being in relation with the driving mechanism for the additional level, second level for instance, of internal shutter panel(s), that is physically independent of the first or external level panel opening mechanism which could have a wide variety of different embodiments.

With reference to the annexed drawings the preferred embodiments of the present invention will be herein described for indicative purpose and by no means as of limitation. It must be noted that for the sake of brevity, only half of the embodiment is illustrated in FIGS. 2, 2*a* and 4 through 8 as the second half is identical in all aspects with the exception that it is reciprocally oppositional in its configuration. Although not illustrated herein, the multi-level window shutter could include only one external and one internal shutter panels such that both panels would open in a same direction (as for a window located close to a wall corner) or only one internal shutter panel cooperating with one of the two external shutter panels to form a three panel shutter, without deviating from the scope of the present invention. Obviously, in the latter cases, either the framing or the frame of the subjacent shutter panel would need to be slightly modified to ensure proper sealing of the window shutter on the opposite side from the side on which the shutter panels open or against the other side external shutter panel, respectively. Furthermore, the present invention would also apply to vertically moving shutter panels (the whole multi-level external window shutter being rotated ninety degrees from the present illustrations), in addition to the more conventional horizontally moving ones.

Figure 1:
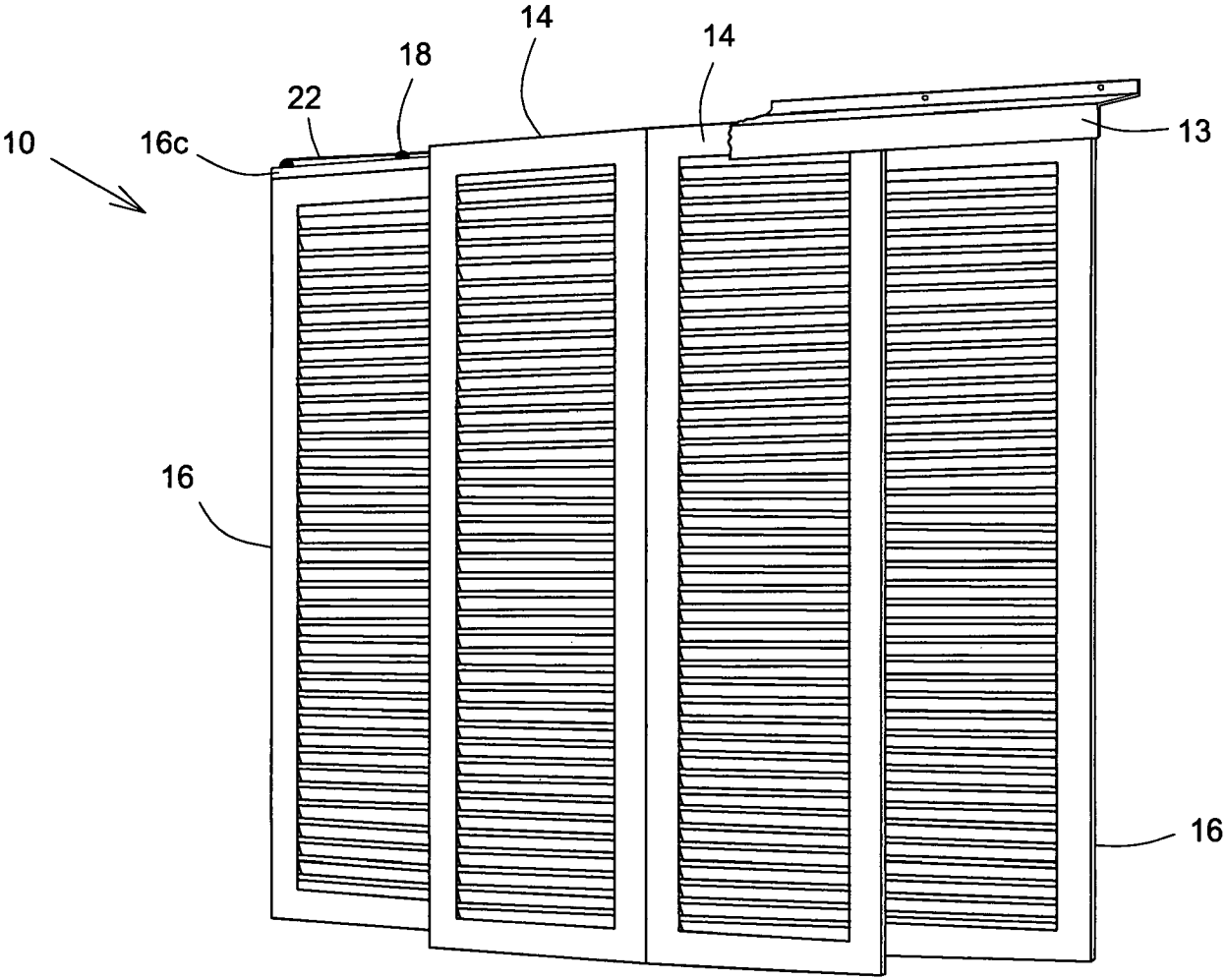
FIG. 1 is a simplified front perspective view of a multi-level window shutter in accordance with an embodiment of the present invention, shown in a closed configuration.
Figure 1A:
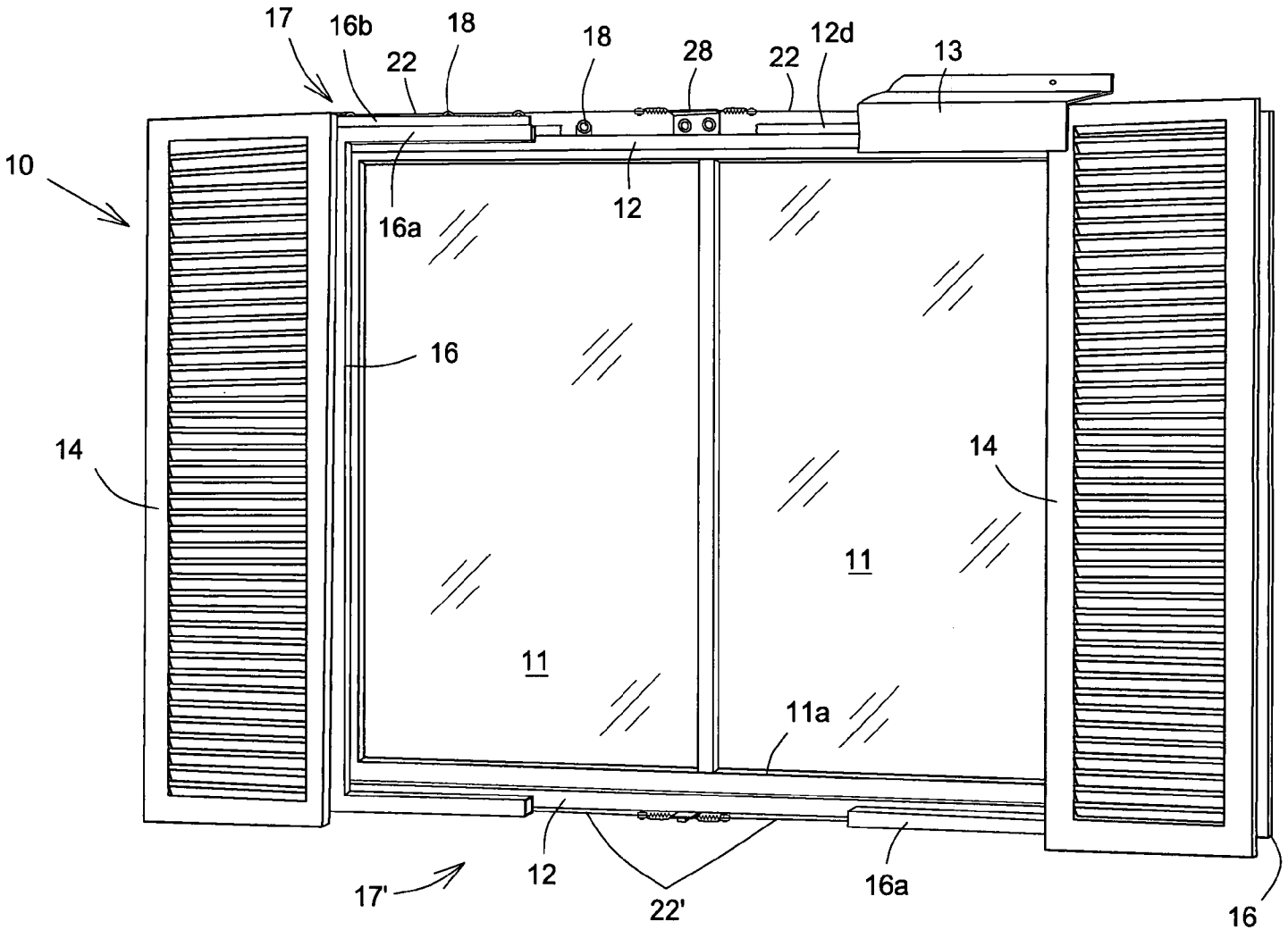
FIG. 1*a* is a view similar to FIG. 1, showing the multi-level window shutter in a fully open configuration.

FIGS. 1 and 1*a* show a multi-level external window shutter 10 in accordance with an embodiment of the present invention in front of a window 11 and its sill 11*a*, in closed and fully open configurations, respectively. The window shutter 10 includes a shutter frame 12 supporting internal 14 and external 16 shutter panels, identified from a transversal point of view (when in the fully closed configuration). In the fully closed configuration (see FIGS. 1, 2, and 3 to 8), the internal and external shutter panels 14, 16 are substantially in a generally side-by-side configuration relative to one another in spaced apart parallel planes, and in the fully open configuration (see FIGS. 1*a* and 2*a*), the internal and external shutter panels 14, 16 are in a generally over-one-another configuration relative to one another in the spaced apart parallel planes. An upper cover 13 is typically mounted either on the shutter frame 12 or directly on the mounting building structure (not shown) above the window 11 to cover the entire window shutter 10 when in the closed configuration, for both aesthetical and protective reasons, against weather elements.

As seen more specifically in FIGS. 2 through 6, the upper section of the shutter frame 12 includes a series of shutter frame supporting guide rollers 12*a*, substantially equidistantly and freely pivotally mounted on corresponding brackets 12*c* attached to a horizontal beam 12*b* thereof (all brackets 12*c* could eventually also be joined into one single piece), about generally horizontal axes, and whose purpose is to guide and movably support the external shutter panel 16 from the central region to the lateral outer end thereof of the shutter frame 12. The guide rollers 12*a* and their brackets 12*c* are typically at least partially hidden, when in open configuration, by a generally protective front shield 12*d* (not shown in FIGS. 2, 2*a*, 5 and 6 for clarity purposes) attached to the horizontal beam 12*b* (see FIGS. 1*a* and 9). Also located at the central region and outer end of the horizontal beam 12*b* of the shutter frame 12 are external 26 and internal 28 cable brackets whose function is to rigidly secure both ends 23 of an elongated flexible link, such as an internal panel drive cable wire 22 or the like of an internal panel opening or drive mechanism 17 used for opening and closing of the internal shutter panel 14. Also shown mounted on the internal shutter panel 14 and located adjacent the external upper edge thereof is a drive attachment bracket 30 which is secured to the internal panel drive cable 22.

Figure 2:
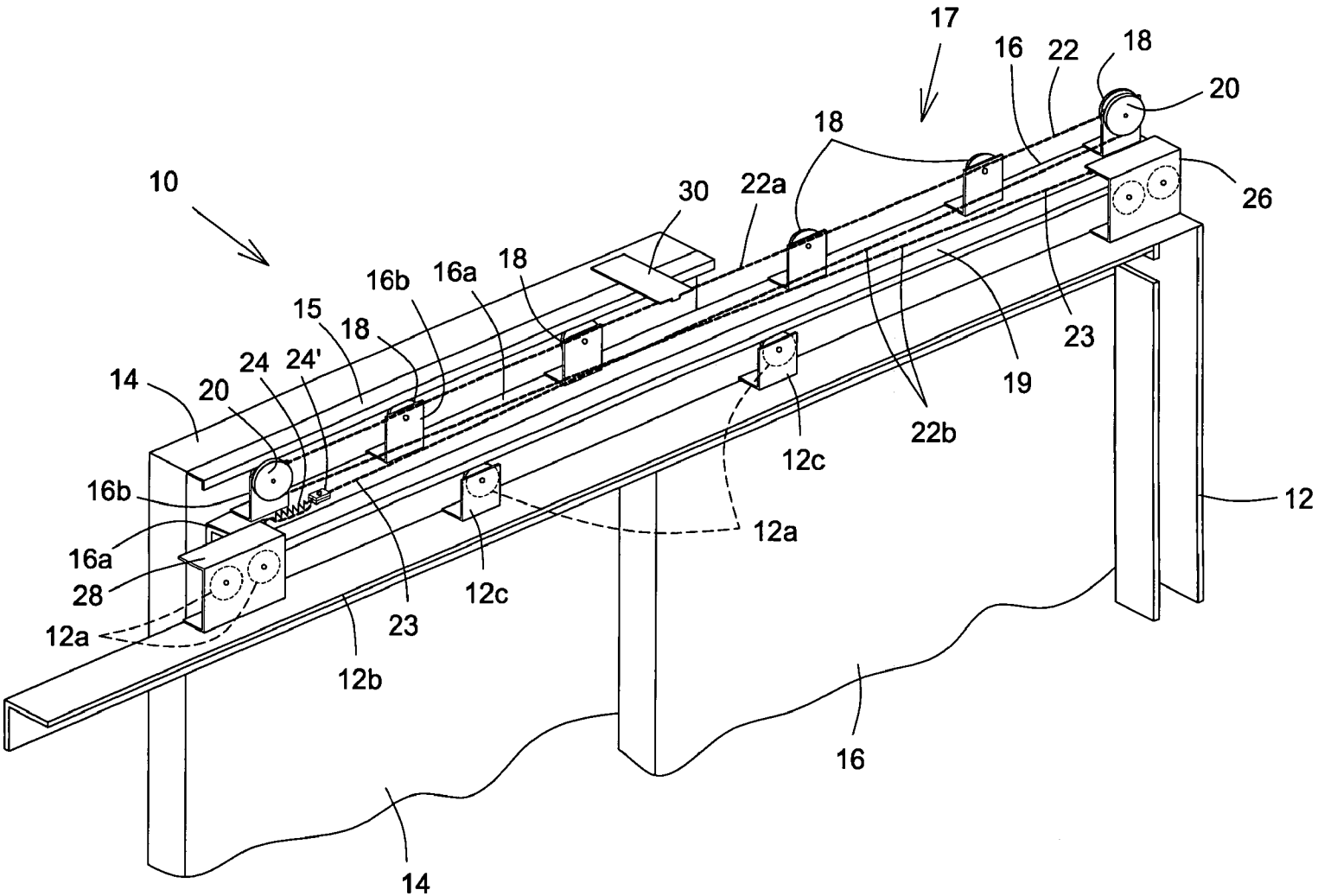
FIG. 2 is a simplified enlarged partially broken top rear perspective view of the embodiment of FIG. 1.
Figure 2A:
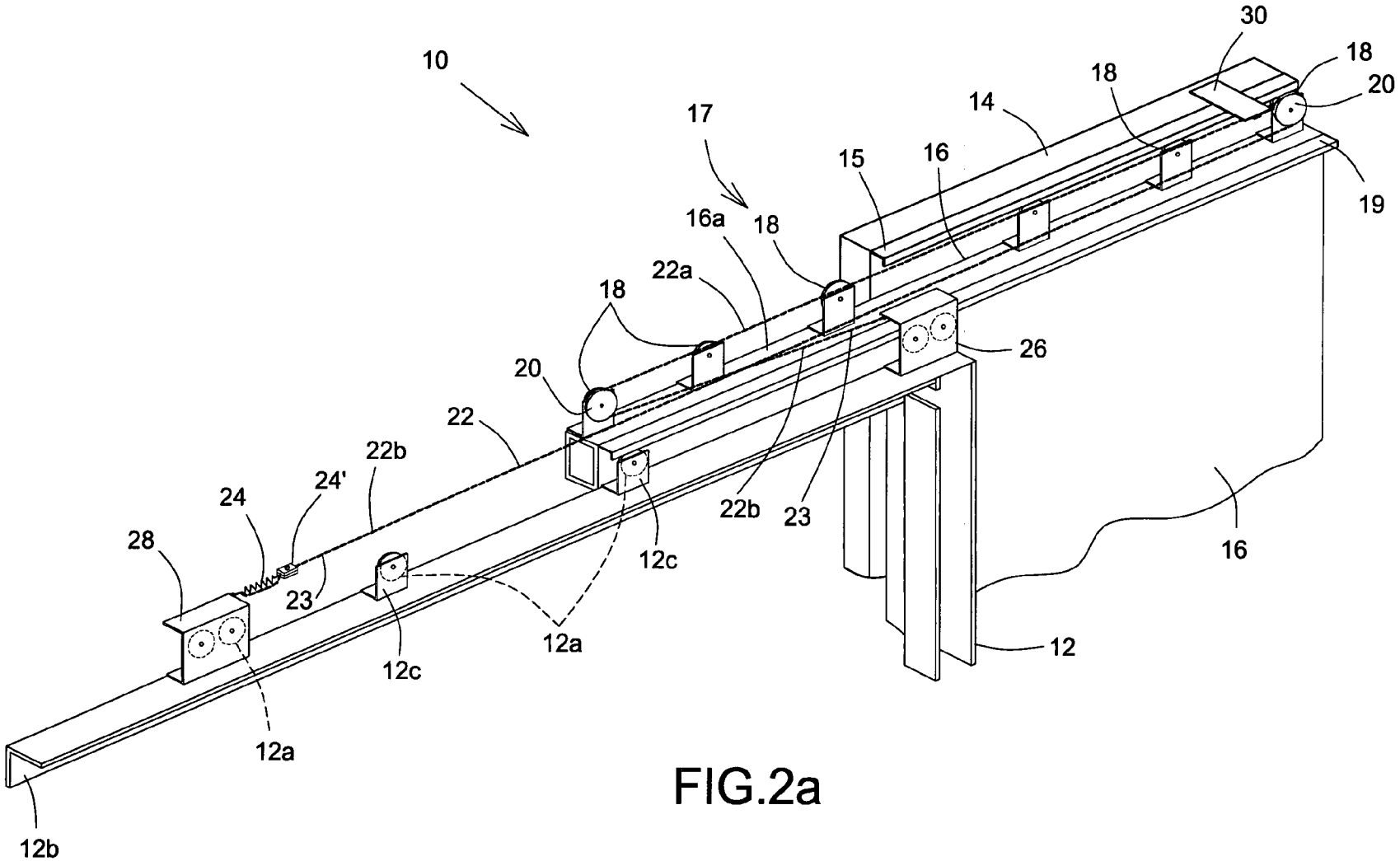
FIG. 2*a* is a view similar to FIG. 2, showing the multi-level window shutter in the fully open configuration.
Figure 3:
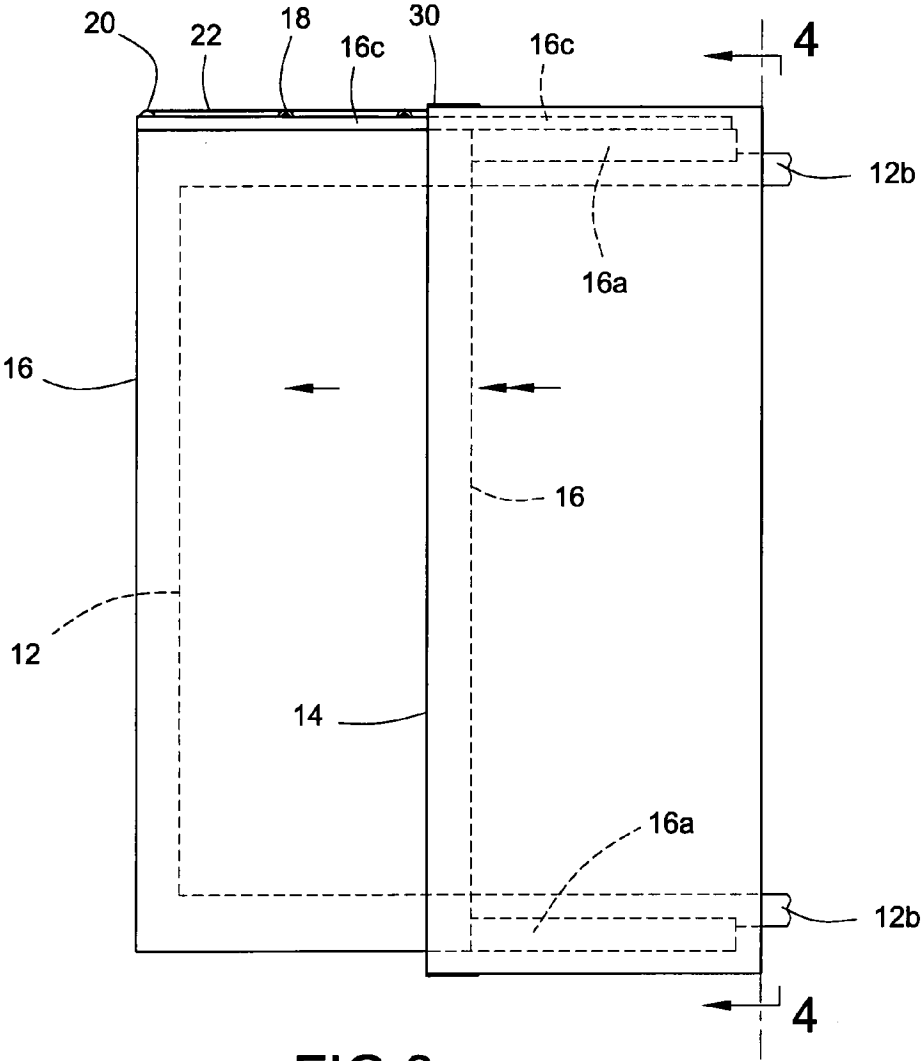
FIG. 3 is a simplified enlarged and partially broken front elevation view of the embodiment of FIG. 2.

The external shutter panel 16 includes an extended panel frame 16*a*, shown in broken lines in FIG. 3, extending internally outwardly from the panel 16 toward the internal shutter panel 14 within the plane of the external shutter panel 16 that serves to at least partially support the internal shutter panel 14, and typically over a length substantially equal to a width of the internal shutter panel 14 to fully support the internal shutter panel over its entire width (as seen in FIGS. 2, 3, and 5 to 8), when in the closed configuration. The upper section of the external shutter panel 16, including the extended panel frame 16*a*, includes a plurality of supporting guide rollers 18 freely pivotally mounted on corresponding brackets 16*b* attached thereto (all brackets 16*b* could eventually also be joined into one single piece) to guide and movably support the internal shutter panel 14 there along when the shutter configuration is being drawn toward the fully open position from the closed configuration, as indicated by the arrows of FIG. 3. Conversely, the same action takes place in reverse when the shutter configuration is drawn toward the closed position from any open configuration. The guide rollers 18 and their brackets 16*b* are alternatively typically at least partially hidden, when in open and closed configuration, by a generally protective front shield 16*c* (not shown in FIGS. 2, 2*a*, 5 and 6 for clarity purposes) attached to the external shutter panel 16 (see FIGS. 1*a* and 9).

Figure 5:
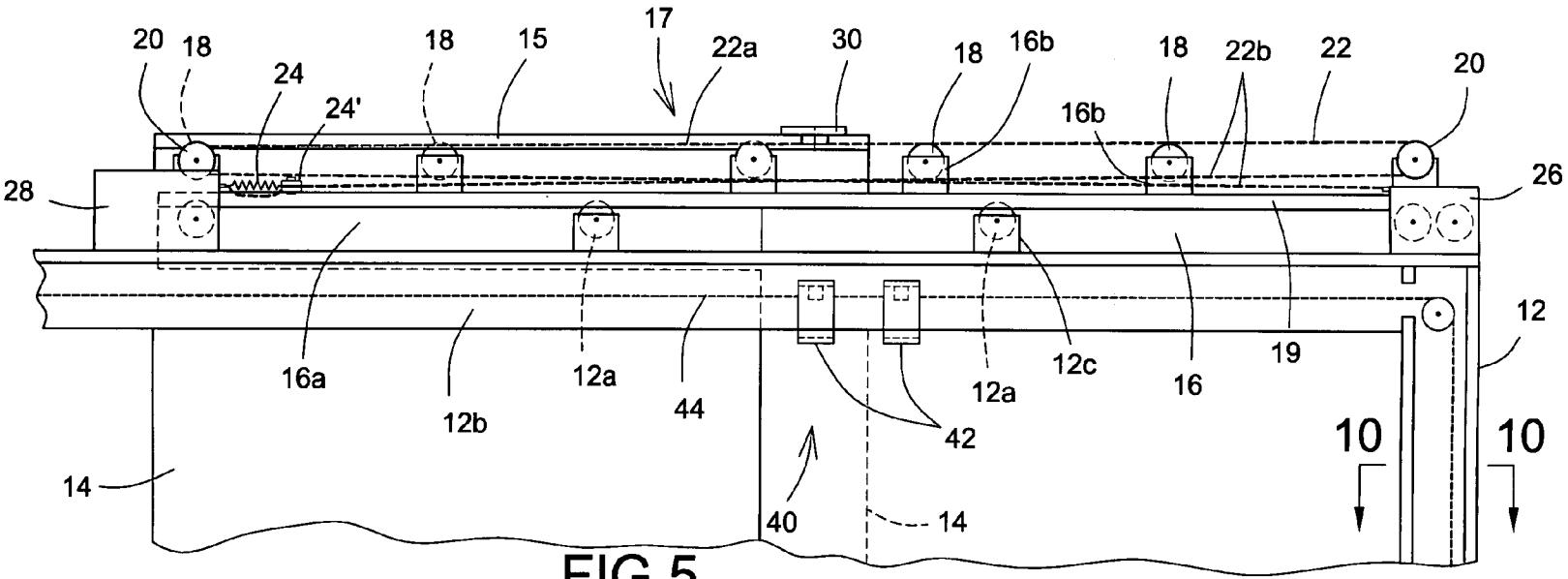
FIG. 5 is a simplified enlarged and partially broken rear elevation view of the embodiment of FIG. 3.
Figure 6:
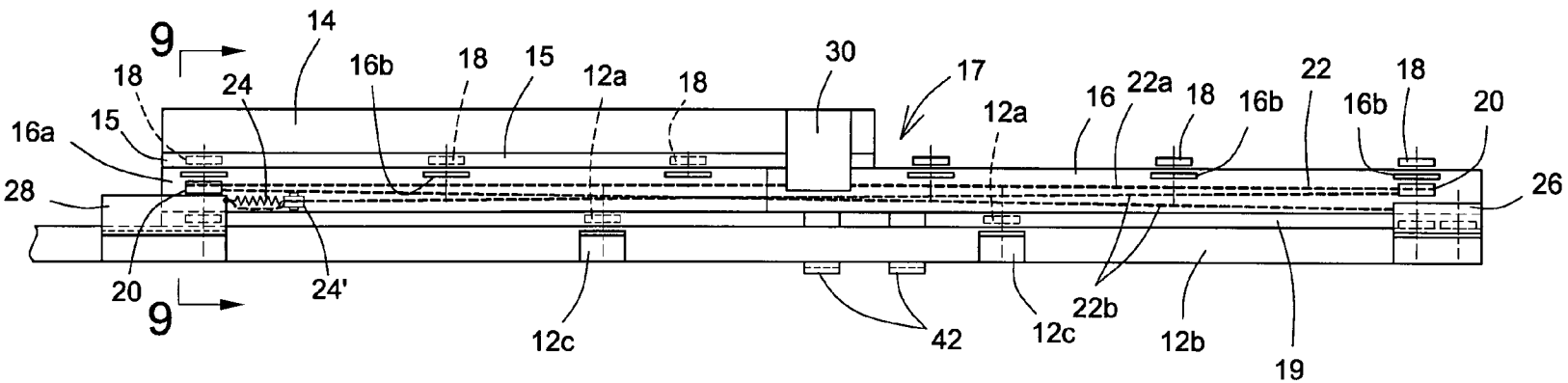
FIG. 6 is a simplified enlarged and partially broken top plan view of the embodiment of FIG. 5.

Further in the internal panel opening mechanism 17, the upper section of the external shutter panel 16 further includes a pair of link engagement gears such as two cable pulleys 20 or the like freely pivotally mounted thereon, preferably mounted coaxially with two of the guide rollers 18, that cooperate by engagement with the internal panel drive cable 22. The two cable pulleys 20 define a link internal section 22*a* of the drive cable 22 extending there between and to which the drive attachment bracket 30 is securably connected to. The two pulleys 20 further define two link end sections 22*b* of the drive cable 22 extending in substantially opposite directions from the link internal section 22*a* between corresponding cable end 23 and a respective pulley 20; the two link end sections 22*b* substantially intersecting one another (with an overlap), as seen in FIGS. 2, 3 and 5.

Figure 4:
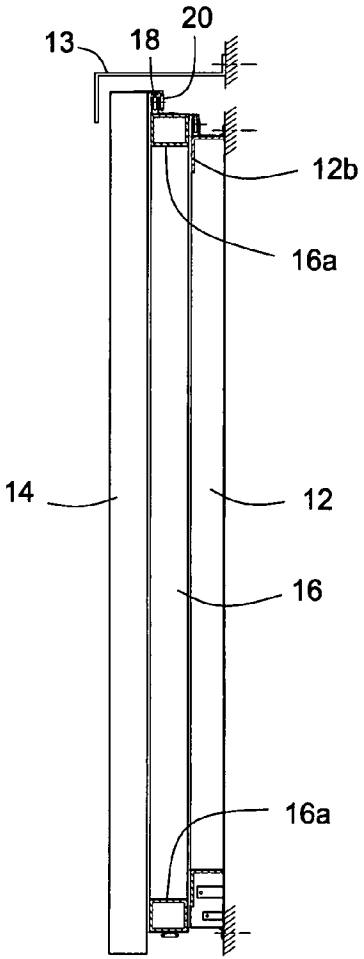
FIG. 4 is a simplified section view taken along line 4-4 of FIG. 3.
Figures 9, 10:
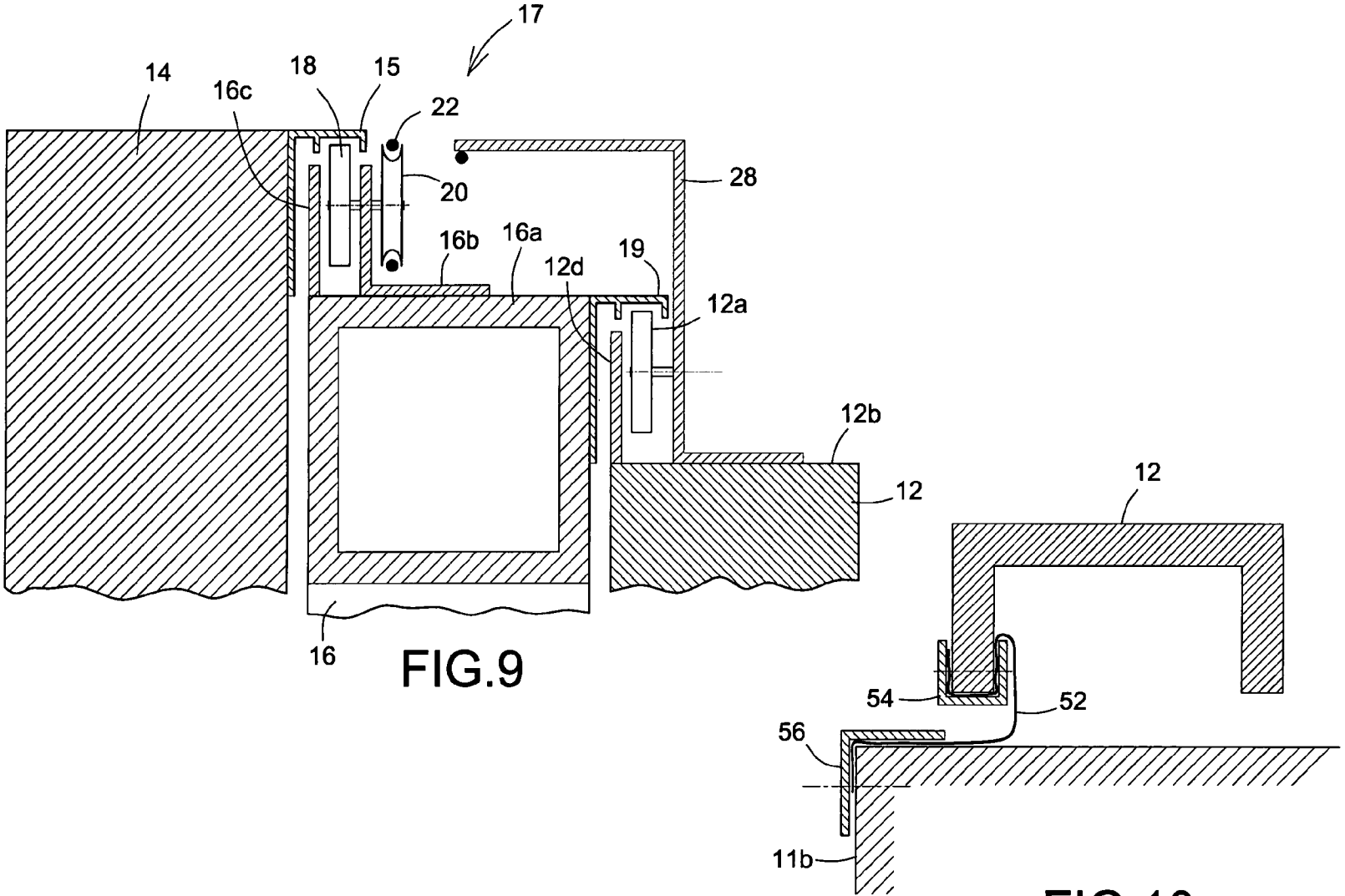
FIG. 9 is a simplified enlarged section view taken along line 9-9 of FIG. 6 with some components taken out for clarity purpose.
FIG. 10 is a simplified enlarged section view taken along line 10-10 of FIG. 5.

As more specifically seen in FIGS. 4 and 9, the internal and external shutter panels 14, 16 typically include respective guide rails or channels 15, 19 mounted thereon to movably cooperate with respective supporting guide rollers 18, 12*a* from the above thereof. The fact the guide rails 15, 19 are located above the respective rollers 18, 12*a*, help protecting the latter from weather elements.

As it would be obvious to one skilled in the art, the distance between the two cable pulleys 20 is at least equal to the linear travel distance of the internal shutter panel 14 relative to the external shutter panel 16, and because they are mounted on the external shutter panel 16 that moves relative to the shutter frame 12 via a frame cable bracket 42 mounted on the external shutter panel 16 and connected to a frame cable 44 of an external panel opening mechanism 40 that is movably mounted on the shutter frame 12 and extends all around the window 11 (see FIGS. 5 and 6 in which the drive cable 22 is physically independent an not directly connected to the external panel opening mechanism 40), the internal shutter panel 14 will simultaneously move twice as fast as the external shutter panel 16 between their respective closed and fully open positions (side-by-side and juxtaposed front-to-back relative to each other, respectively). The drive cable 22 is typically secured to the cable brackets 26, 28 via at least one, preferably both (not shown), of the two ends 23 with a cable tightening or tensioning mechanism. Typically, the tightening mechanism includes an elastic member such as a tension spring 24 or the like elastically connecting the cable bracket 26, 28 to a mobile cable clamp 24' clamping the corresponding end 23 of the cable 22. The mobile cable clamp 24' allows selling of the section of the cable 22 being clamped thereby while the tension spring 24 ensures constant tension into the cable 22 regardless of materials expansion and/or retraction due to temperature changes. The loose and free portion of the end 23 of the cable 22 running beyond the cable clamp 24' is typically secured to The corresponding cable bracket 26, 28 to prevent any possible obstruction therefrom and also tightening mechanism disassembly in the event of rupture of the tension spring 24.

Figure 7:
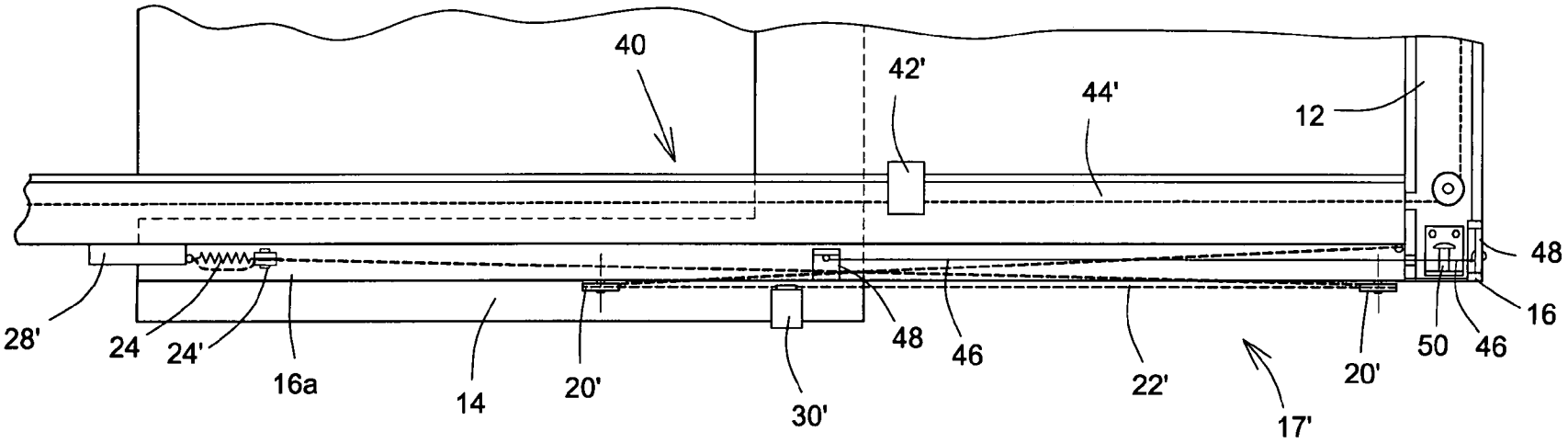
FIG. 7 is a simplified enlarged and partially broken rear elevation view of the embodiment of FIG. 3, showing the bottom portion of the shutter panels.
Figure 8:
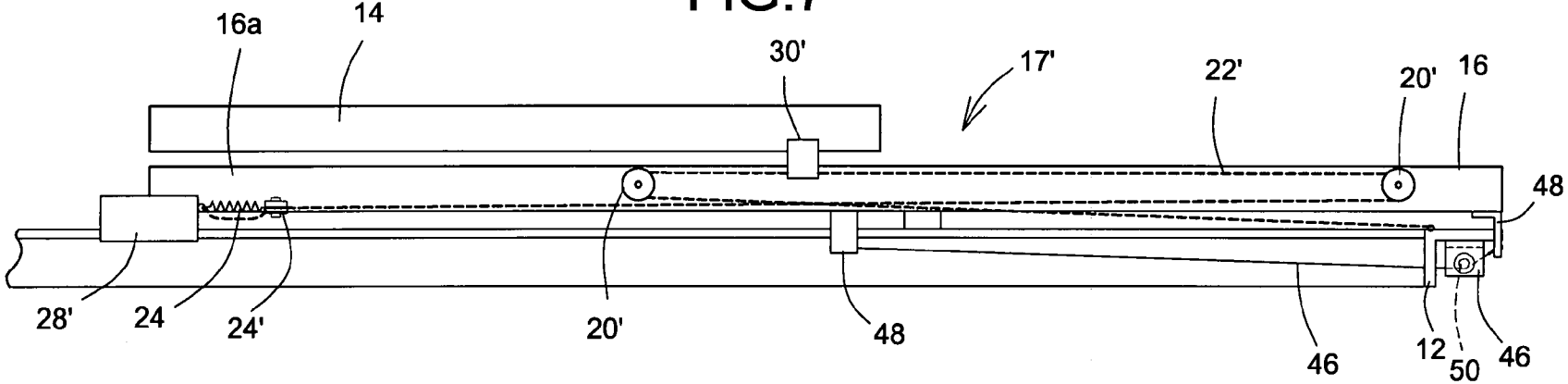
FIG. 8 is a simplified enlarged and partially broken bottom plan view of the embodiment of FIG. 7.

Referring now more specifically to FIGS. 7 and 8, the lower sections of the internal and external shutter panels 14, 16 are similar to their respective upper section with the difference that there is no lower guide roller with corresponding guide rail for either shutter panel since the support occur substantially only at the upper sections, and that the lower two cable pulleys 20' cooperating with the internal panel lower drive cable 22' attached at both ends to the shutter frame 12 and internal cable bracket 28' are freely pivotally mounted on the external panel lower section about generally vertical axes to be generally perpendicular to the panel planes in order to essentially reduce the overall amount of space required. Obviously, the lower section 17' of the internal panel drive mechanism operates in parallel to the upper section 17 described hereinabove and could also have the same orientation without departing from the scope of the present invention. Similarly for the shutter or external panel opening mechanism 40 with the frame cable bracket 42' mounted on the external shutter panel 16 and connected to a second frame cable 44', generally parallel to the first frame cable 44 and moving in the same direction (but opposite peripheral direction, since in the lower section, as described in U.S. Pat. No. 6,658,793), that is also movably mounted on the shutter frame 12 and extends all around the window 11 (see FIG. 7).

As shown throughout the different Figures, the external shutter panels 16 generally slightly protrude upwardly and downwardly from the subjacent shutter frame 12 to essentially hide, protect and provide room for the shutter opening mechanism 40. Similarly, the internal shutter panels 14 generally slightly protrude upwardly and downwardly from the subjacent external shutter panel 16 also to essentially hide, protect and provide room for the internal panel drive mechanism 17.

Although not specifically shown, all interfaces between adjacent shutter panels 14, 16 and shutter frame 12, when in closed configuration, are typically sealed with conventional flexible sealing device, an example of which is illustrated in U.S. Pat. No. 6,658,793, to ensure proper protection against weather elements and good thermal insulation properties provided by the multi-level window shutter 10.

Accordingly, to improve efficiency of the flexible sealing device by a tight retaining of the external shutter panel 16 against the frame 12 especially in high wind environment, the upper sections of the external shutter panels 16 are maintained against the frame 12 in any configuration by the different supporting guide rollers 12*a* cooperating with the guide rail 19. At the other end, the lower sections of the external shutter panels 16 are typically maintained in any configuration against the frame 12 by an out-of-plane retaining mechanism such as a flexible retaining wire 46 located just below the frame 12 and secured at both ends to the external shutter panel 16 via respective wire brackets 48, and sliding (in tension) against a panel retaining pin 50 secured to the shutter frame 12, as shown in FIGS. 7 and 8. Although not illustrated, a similar retaining mechanism could be used between the lower sections of the internal and external shutter panels 14, 16.

To further improve the protection against weather elements, the multi-level external window shutter 10 is typically provided with a protecting skirt 52 closing the gap between the shutter frame 12 and the external corner 11*b* of the intersection between the periphery of the window 11 and the external building wall made out of bricks, stones, plastic, wood or the like conventional external finish material for buildings, as shown in FIG. 10. The skirt 52 is typically secured to the shutter frame 12 using a U-shaped molding bracket 54 or the like fastened thereto and to a location adjacent the window external corners 11*b* using an angled molding 56 or the like fastened thereto.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A multi-level window shutter having a shutter frame movably supporting at least one first level external shutter panel between an external closed position and an external open position and an external panel opening mechanism mounted on the shutter frame and connected to the external panel for selective displacement thereof relative to the shutter frame, the window shutter comprising:

at least one second revel internal shutter panel movably, directly and entirely supported by the external shutter panel between an internal closed position with the external and internal panels being substantially in a generally side-by-side configuration relative to one another in spaced apart parallel planes with the external panel being in the external closed position and an internal open position with the external and internal panels being in a generally over-one-another configuration relative to one another in the spaced apart parallel planes with the external panel being in the external open position; and an internal panel opening mechanism mounted on the shutter frame and connected to the external panel and to the internal panel for simultaneous displacement of the internal panel upon displacement of the external panel relative to the shutter frame, the internal panel opening mechanism being physically independent from the external panel opening mechanism and being activated by the external panel upon displacement thereof relative to the shutter frame;

the external panel includes an external panel frame having a frame extension for supporting the internal panel when in the internal closed position, the frame extension extending generally internally away at least from an upper section of the external panel frame in the plane of the external panel, the frame extension extending over a length substantially equal to a width of the internal panel so as to support the internal panel over its entire width when in the internal closed position.

2. The window shutter of claim 1, wherein the external and internal panels are hermetically secured against each other when in the closed configuration.

3. The window shutter of claim 1, wherein the internal opening mechanism includes an elongated flexible link having first and second ends attachably connectable to the shutter frame, the flexible link movably mounting on the external panel frame and attaching to the internal panel for displacement thereof upon displacement of the external panel.

4. The window shutter of claim 3, wherein the internal opening mechanism includes a pair of link engagement gears pivotally mounted on the external panel frame, the flexible link engaging the gears and defining a link internal section therebetween, the internal panel attachably connecting to the link internal section of the flexible link.

5. The window shutter of claim 4, wherein the flexible link further defines first and second link end sections extending in substantially opposite directions from the link internal section between corresponding first and second link end and a respective said gears, the first and second link end sections substantially intersecting one another.

6. The window shutter of claim 5, wherein the flexible link is a cable wire and the first and second gears are first and second cable pulleys.

7. The window shutter of claim 5, wherein at least one of the first and second link ends is rigidly attached to the shutter frame.

8. The window shutter of claim 5, wherein at least one of the first and second link ends is elastically attached to the shutter frame so as to ensure a tension within the flexible link.

9. The window shutter of claim 8, wherein the at least one link end is attached to the shutter frame, the flexible link being further and elastically connected to the shutter frame adjacent the at least one link end by a cable tensioning mechanism to ensure said tension in the flexible link.

10. The window shutter of claim 9, wherein the cable tensioning mechanism is a tension spring.

11. The window shutter of claim 1, wherein the internal opening mechanism allows for a linear displacement of the internal panel to be substantially twice a simultaneous linear displacement of the external panel.

12. The window shutter of claim 1, wherein the internal panel includes a guide channel engaging over a plurality of support rollers pivotally mounted on the external shutter panel.

13. The window shutter of claim 12, wherein the guide channel and the plurality of support rollers are located within a guiding plane substantially parallel to the panel planes.

14. The window shutter of claim 13, wherein the guiding plane is substantially coplanar with the external panel plane.

15. The window shutter of claim 1, wherein the internal opening mechanism is located on both upper and lower sections of the shutter frame and the external and internal shutter panels.

16. The window shutter of claim 15, wherein the internal opening mechanism located on the lower sections of the shutter frame and the external and internal shutter panels is oriented in a plane generally perpendicular to the external and internal panel planes.

17. The window shutter of claim 1, further including an out-of-plane retaining mechanism mounted on the external panel and connected to the shutter frame to prevent any out-of-plane displacement of the external panel relative to the shutter frame.

18. The window shutter of claim 17, wherein the retaining mechanism includes a flexible wire secured to the external shutter panel slidably engaging a corresponding pin attached to the shutter frame between the external open and closed of the external shutter panel.

19. A multi-level window shutter for selectively closing a window opening, the window shutter comprising:

a shutter frame mountable around the window opening;

at least one first level external shutter panel movably supported by the shutter frame between an external closed position and an external open position;

an external panel opening mechanism mounted on the shutter frame and connected to the external panel for selective displacement thereof relative to the shutter frame;

at least one second level internal shutter panel movably, directly and entirely supported by the external shutter panel between an internal closed position with the external and internal panels being substantially in a generally side-by-side configuration relative to one another in spaced apart parallel planes with the external panel being in the external closed position and an internal open position with the external and internal panels being in a generally over-one-another configuration relative to one another in the spaced apart parallel planes with the external panel being in the external open position; and an internal panel opening mechanism mounted on the shutter frame and connected to the external panel and to the internal panel for simultaneous displacement of the internal panel upon displacement of the external panel relative to the shutter frame, the internal panel opening mechanism being physically independent from the external panel opening mechanism and being activated by the external panel upon displacement thereof relative to the shutter frame;

the external panel includes an external panel frame having a frame extension for supporting the internal panel when in the internal closed position, the frame extension extending generally internally away at least from an upper section of the external panel frame in the plane of the external panel, the frame extension extending over a length substantially equal to a width of the internal panel so as to support the internal panel over its entire width when in the internal closed position.

* * * * *